United States Patent [19]

Yanagi et al.

[11] Patent Number: 4,869,310

[45] Date of Patent: Sep. 26, 1989

[54] BELT TYPE CONTINUOUS CASTING MACHINE

[75] Inventors: Kenichi Yanagi; Yoshiki Mito; Kanji Hayashi, all of Hiroshima, Japan

[73] Assignee: Mitsubishi Jokogyo Kabushiki Kaisha, Tokyo, Japan

[21] Appl. No.: 171,915

[22] Filed: Jan. 5, 1988

[30] Foreign Application Priority Data

Jan. 27, 1987 [JP] Japan ..... 62-15084

[51] Int. Cl.[4] ..... B22D 11/06

[52] U.S. Cl. ..... 164/431; 164/436

[58] Field of Search ..... 164/430, 431, 432, 436, 164/481, 491

[56] References Cited

U.S. PATENT DOCUMENTS

| | | | |
|---|---|---|---|
| 4,510,990 | 4/1985 | Artz et al. | 164/431 |
| 4,660,617 | 4/1987 | Tsutsumi et al. | 164/491 |
| 4,669,526 | 6/1987 | Hury | 164/418 |
| 4,682,646 | 7/1987 | Hulek | 164/481 |
| 4,727,925 | 3/1988 | Asari et al. | 164/481 |

FOREIGN PATENT DOCUMENTS

| | | |
|---|---|---|
| 39-13361 | 7/1939 | Japan . |
| 61-6741 | 1/1986 | Japan . |

*Primary Examiner*—Richard K. Seidel

*Attorney, Agent, or Firm*—Wenderoth, Lind & Ponack

[57] ABSTRACT

The known belt type continuous casting machine is improved in that a pair of guides for side dam block groups are disposed at opposite sides, in the widthwise direction, of a cast piece. Each of the guides includes guide beams disposed in two parallel rows displaced in direction of the thickness of the cast piece. Each of a pair of side dams which are movable in synchronism with feeding of the cast piece is formed of a side dam block group in one row. Each of the side dam block groups is divided into two sub-groups, each of which has a length longer than a contact length between the side dam block group and the cast piece and each of which is guided by a separate guide beam.

9 Claims, 6 Drawing Sheets

BELT TYPE CONTINUOUS CASTING MACHINE

BACKGROUND OF THE INVENTION

1. Field of the Invention

The present invention relates to a belt type continuous casting machine, and more particularly to such casting machine provided with synchronous variable-width side dams.

2. Description of the Prior Art

One example of a belt type continuous casting machine in the prior art is shown in FIGS. 7 and 8, the latter figure being a vertical cross-sectional view taken along line VIII—VIII in the former figure as viewed in the direction of the arrows therein. As will be seen from these figures, the casting machine is composed of principal component members such as a pair of water-cooled belts 3 disposed in parallel to each other and spaced by a distance corresponding to a thickness T of a cast piece 21 to be manufactured, tension pulleys 1 supported by respective vertically movable bearing boxes 5 and having the belts 3 wound therearound, drive pulleys 2 supported by respective fixedly disposed bearing boxes 6, and side members or dams 4 fixedly disposed so that the belts 3 are slidable over and pinch therebetween the side dams 4.

The water-cooled belts 3 and the side dams 4 are provided with respective water-cooling devices, not shown, so that solidification heat absorbed from molten metal 20 may be cooled thereby. The tension pulleys 1 are associated with a pulling device, not shown, for pulling them upwards, as viewed in the drawings, such as air cylinders, by the intermediary of the bearing boxes 5, while the drive pulleys 2 are associated with a driving device, not shown.

By means of such driving device, the two water-cooled belts 3 are moved or rotated via the drive pulleys 2 in directions indicated by arrows $\alpha$ and slide along the side dams 4, and molten metal 20 is continuously fed into the mold section formed of the side dams 4 and the water-cooled belts 3. Reference numeral 20*a* designates a top surface of the molten metal 20. The molten metal 20 is cooled and solidified by the water-cooled belts 3 moving downwards as viewed in the drawings at an appropriate speed and by the fixed side dams 4. The thus solidified metal is discharged or ejected as cast piece 21 downwards as viewed in the drawings as shown by an arrow $\beta$ at a speed substantially equal to the linear speed of the water-cooled belts 3, and then it is sent to the next step of the process.

Another example of a belt type continuous casting machine in the prior art is shown in FIGS. 9 and 10, the latter figure being a vertical cross-sectional view taken along line X—X in the former figure as viewed in the direction of the arrows therein. As will be seen from these figures, the casting machine is composed of principal component members such as a pair of water-cooled belts 3 disposed in parallel to each other and spaced by a distance corresponding to a thickness T of a cast piece 21 to be manufactued, tension pulleys 1 supported by respective vertically movable bearing boxes 5 and having the belts 3 wound therearound, drive pulleys 2 supported by respective fixedly disposed bearing boxes 6, and a pair of movable type side members or dams 7 pinched between the two belts 3.

Each of the side dams 7 consists of a large number of metal blocks 7*a* which are constrained on a continuous flexible metal belt 7*b* with their adjacent ends held in a face-to-face relationship. The water-cooled belts 3 and the side dams 7 are provided with respective water-cooling devices not shown so that solidification heat absorbed from molten metal 20 may be cooled thereby. The tension pulleys 1 are associated with a pulling device, not shown, for pulling them upwards, as viewed in the drawings, such as air cylinders, by the intermediary of the bearing boxes 5, while the drive pulleys 2 are associated with a driving device, not shown.

When both water-cooled belts 3 are moved or rotated in directions indicated by arrows $\alpha$ via the drive pulleys 2 by means of the driving, device, the two side dams 7 are moved in the direction indicated by an arrow $\gamma$ due to a pinching force of the water-cooled belts 3. Molten metal 20 is continuously fed into the mold section formed of the water-cooled belts 3 and side dams 7. The molten metal 20 is cooled and solidified by the water-cooled belts 3 and the side dams 7 moving downwards as viewed in the drawings at an appropriate speed. The thus solidified metal is discharged or ejected as a cast piece 21 downwards as viewed in the drawings as shown by an arrow $\beta$ at a speed substantially equal to the linear speed of the water-cooled belts 3, and then it is sent to the next step of the process.

The fixed type side dams 4 shown in FIGS. 7 and 8 involve the problem that they are liable to cause seizure when the moving molten metal 20 solidifies. In addition, both such fixed type side dams 4 and the movable type side dams 7 shown in FIGS. 9 and 10 have a shortcoming that, during a continuous casting operation, a change in the width of the cast piece 21 is not possible. Accordingly, with either the casting machine shown in FIGS. 7 and 8 or that shown in FIGS. 9 and 10, in order to change the width of the cast piece 21, it is necessary to employ complicated operations including interruption of pouring of the molten metal, and after discharge of the cast piece 21, changing the positions of the side dams 4 or 7 are change, and then again starting casting. The resultant loss of time is tremendous.

SUMMARY OF THE INVENTION

It is therefore one object of the present invention to provide a belt type continuous casting machine in which, while the problem of seizure is resolved by moving in synchronism with a cast piece, it is possible to change the width of the cast piece while carrying out continuous casting.

According to one feature of the present invention, there is provided a belt type continuous casting machine, in which a pair of guides for side dam block groups are disposed at the opposite sides in the widthwise direction of a cast piece. Each of the guides includes guide beams disposed in two parallel rows displaced in the direction of the thickness of the cast piece. Each of a pair of side dams, which are movable in synchronism with feeding of the cast piece, is formed of a side dam block group in one row, and each of the side dam block groups is divided into two sub-groups, each of which has a length longer than a contact length between the side dam block group and the cast piece, and each of which is guided by a separate guide beam.

According to a more specific feature of the present invention, there is provided a belt type continuous casting machine of the type wherein molten metal is fed into a mold space between a pair of water-cooled belts disposed in parallel to each other and moved in opposite directions toward each other, and a cast piece solidified in a plate shape is continuously withdrawn therefrom. A pair of side dam block groups, each aligned in one row, are moved in a recirculating manner in synchronism with the moving speed of the pair of water-cooled belts. A portion of each side dam block group on the side of the cast piece is pinched between the two water-cooled belts. A pair of guides for the side dam block groups are disposed to extend in the moving direction of the side dam block groups, at least in the interval where the side dam block groups are held in contact with the cast piece. Each of the guides includes guide beams disposed in two parallel rows displaced in the direction of the thickness of the cast piece and individually movable in the widthwise direction of the cast piece, so that each side dam block group in one row is guided by the respective guide beams in two rows. Each side dam block group is divided into two sub-groups, each of which has a length longer than a contact length between the side dam block group and the cast piece.

During operation of the belt type continuous casting machine according to the present invention, if one of the guide beams corresponding to one side dam block sub-group not held in contact with the cast piece is moved in the widthwise direction of the cast piece, then the respective side dam blocks in such one side dam block sub-group will successively move in the widthwise direction of the cast piece while being guided by the above-mentioned one guide beam before they come into contact with the molten metal, as a result of the movement o such side dam block group. When the above-mentioned one side dam block sub-group moved in the widthwise direction of the cast piece in the above-described manner has reached the location where the molten metal is present, the width of the cast piece being cast is changed.

According to the present invention, in addition to the advantage that a cast piece of high quality without defects such as caused by seizure can be obtained because side dams are moved in synchronism with the cast piece, a further advantage can be obtained in that by moving a guide beam corresponding to a side dam block sub-group not held in contact with the cast piece in the widthwise direction of the cast piece during a continuous casting operation, the width of the cast piece can be changed while continuously carrying out casting without interruption.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
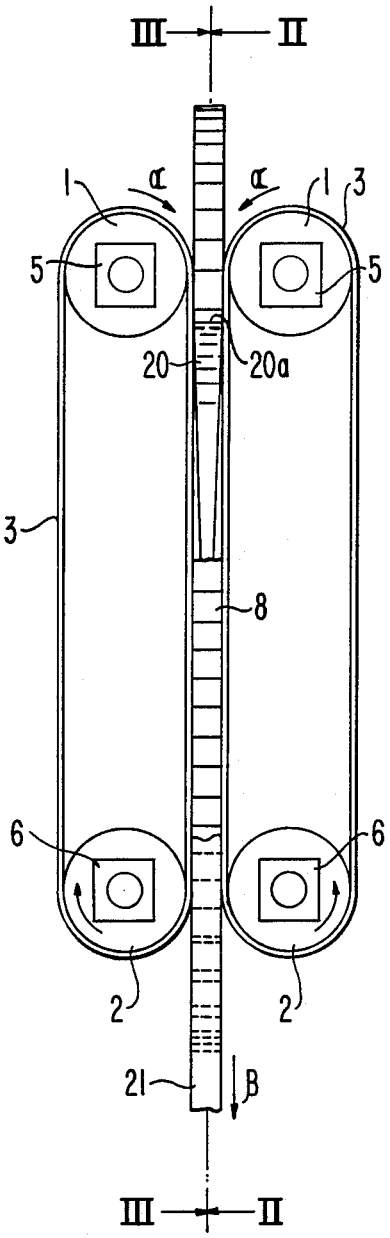
FIG. 1 is a side view schematically showing a belt type continuous casting machine according to a preferred embodiment of the present invention.

Now one preferred embodiment of the present invention will be described with reference to FIGS. 1 to 6 of the accompanying drawings. It is to be noted that in these figures component members corresponding to those used in the continuous casting machines in the prior art illustrated in FIGS. 7 to 10 are given like reference numerals, and further description thereof will be omitted.

As shown in FIGS. 1 to 6, each of a pair of side dams or members 8 is formed in an endless form and moves with a portion on the side of a cast piece 21 pinched between a pair of water-cooled belts 3. Each side dam 8 includes a group of side dam blocks 8*a* and 8*a*′ aligned in one row and formed of two sub-groups, that is, a sub-group of side dam blocks 8*a* and a sub-group of side dam blocks 8*a*′. Each sub-group has a length which is longer than a contact length L (See FIGS. 2 and 3) between the cast piece 21 and the side dams 8.

As will be explained in detail in the following, the side dam blocks 8*a* in one sub-group are connected with one another by means of an endlessly flexible metal belt 8*b*, while the side dam blocks 8*a*′ in the other sub-group are connected with one another by means of a endless flexible metal belt 8*c*. Each side dam 8 has a loop-shaped endless configuration formed by the above-described sub-groups 8*a* and 8*a*′.

Figure 2:
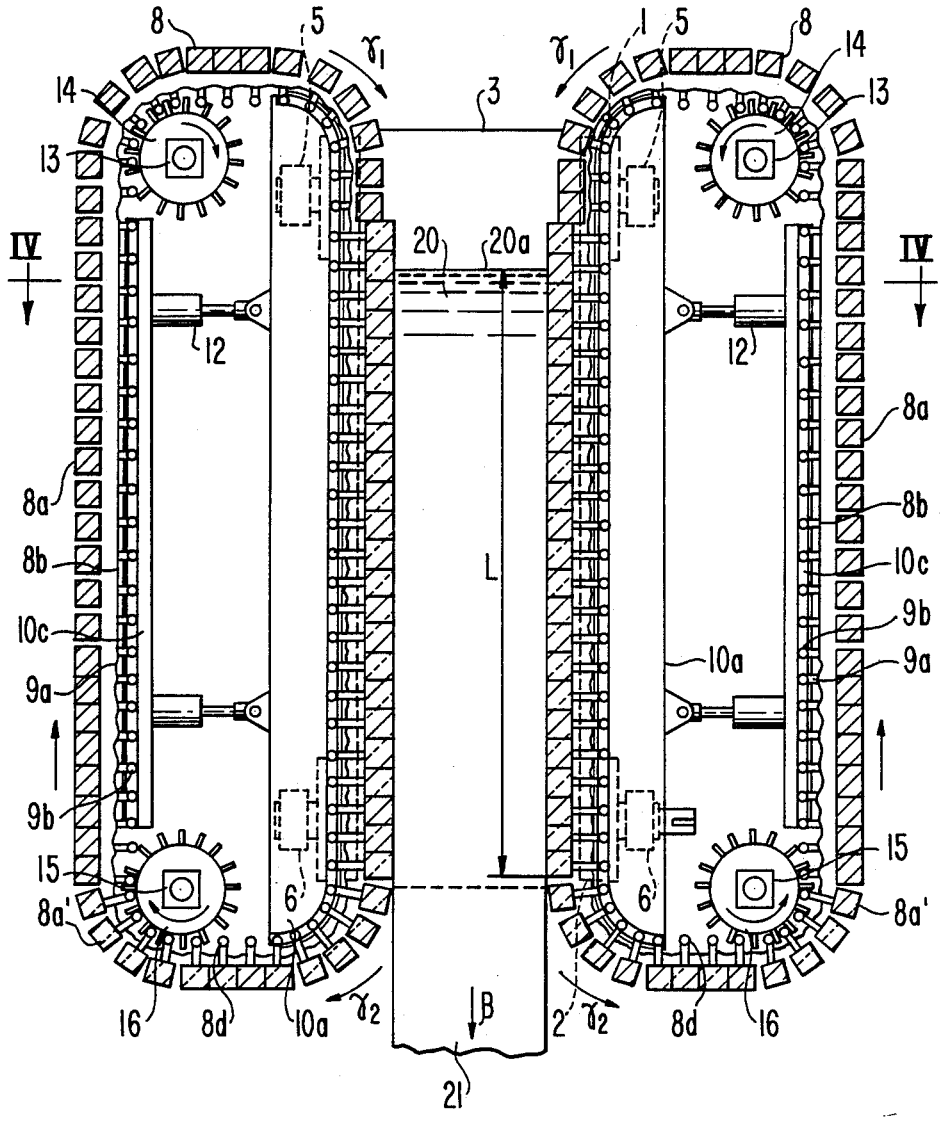
FIG. 2 is a vertical cross-sectional front view taken along line II—II in FIG. 1 as viewed in the direction of the arrows thereof.

Each side dam 8 has associated therewith a respective guide which extends in the direction of movement of the side dam blocks 8*a* and 8*a*′, that is, in the vertical direction at least over the interval where the side dam blocks come into contact with cast piece 21 (the interval having a length L as shown in FIG. 2). In the illustrated continuous casting machine, each guide is disposed along a part of the path of movement of the side dam blocks, namely over an upper portion thereof where the side dam blocks move nearly horizontally towards the molten metal 20, a vertical portion where the side dam blocks move downwards, and a subsequent portion where the side dam blocks leave the cast piece 21 and begin to move nearly horizontally away therefrom. Reference numerals 10*c* and 10*d* designate fixed guide beams disposed at a portion of the path of movement of the side dam blocks on the side opposite to the cast piece 21, i.e. where the side dam blocks move from below to above, with a small gap or space maintained therebetween. The above-mentioned guide is composed of a pair of guide beams 10*a* and 10*b* disposed with a small gap or space maintained therebetween. The guide beams 10*a* and 10*b* are connected to the fixed guide beams 10*c* and 10*d*, respectively, via driving devices such as air cylinders 12 or the like, and they are adapted to be moved independently in the widthwise direction of the cast piece 21 by actuating the respective driving devices.

Figure 4:
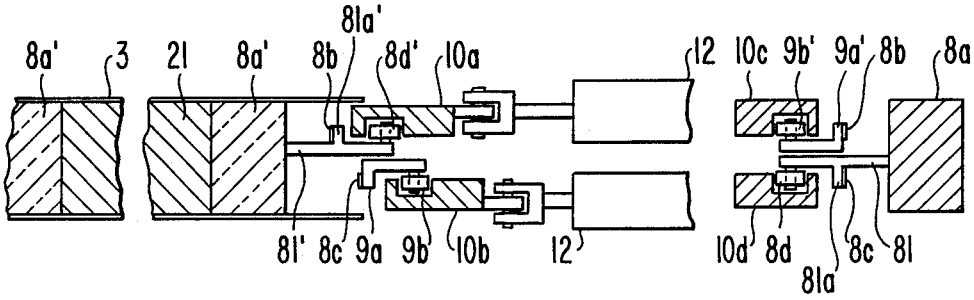
FIG. 4 is a horizontal cross-sectional plan view taken along line IV—IV in FIG. 2 as viewed in the direction of the arrows thereof.
Figure 5:
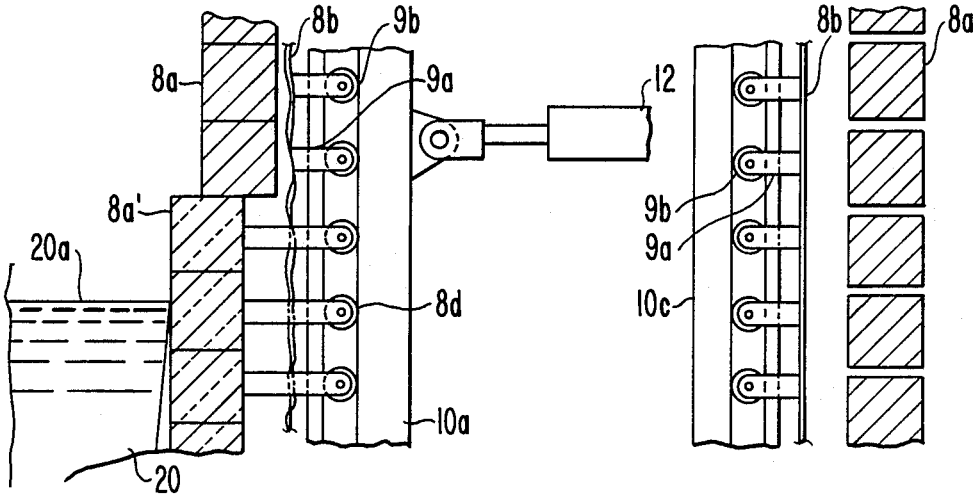
FIG. 5 is an enlarged front view of a part of FIG. 2.
Figure 6:
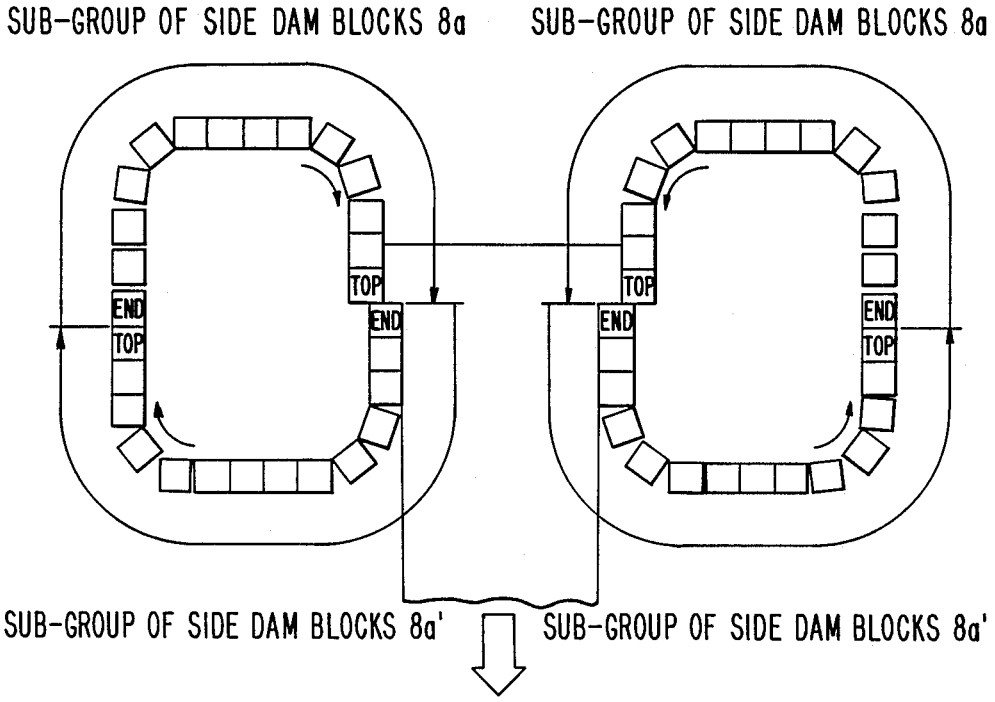
FIG. 6 is a schematic view generally showing two side dam block groups each consisting of two sub-groups.
Figure 7:
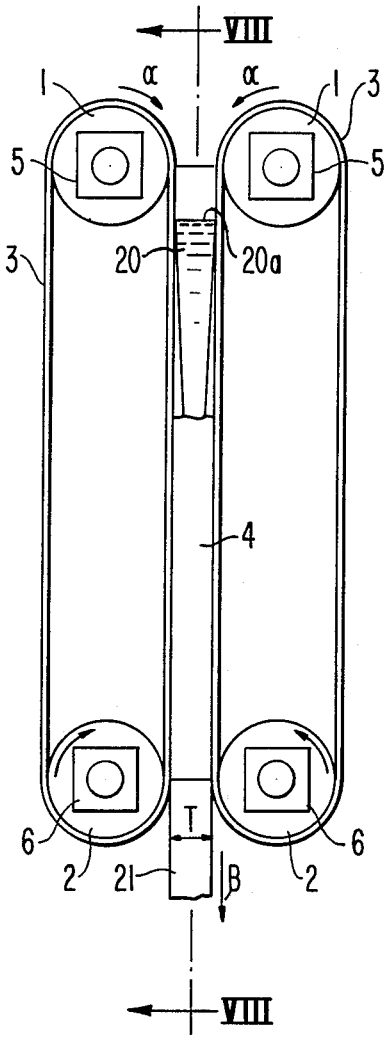
FIG. 7 (PRIOR ART)
FIG. 7 is a side view showing one example of a belt type continuous casting machine in the prior art.
Figure 8:
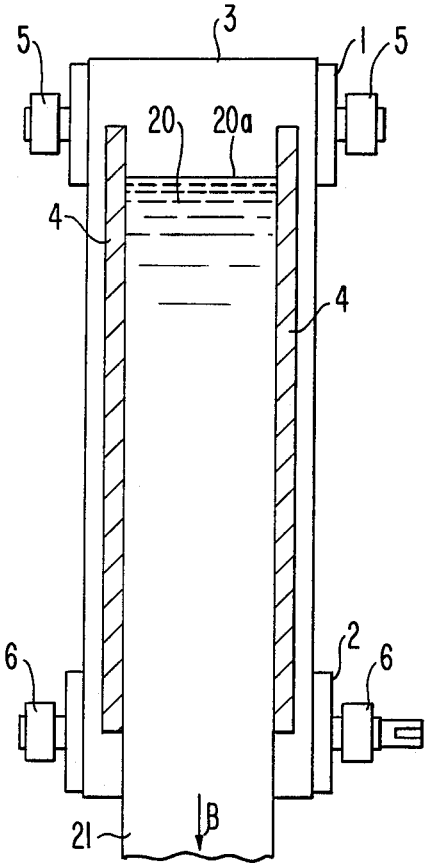
FIG. 8 (PRIOR ART)
FIG. 8 is a vertical cross-sectional front viewtaken along line VIII—VIII in FIG. 7 as viewed in the direction of the arrows thereof.
Figure 9:
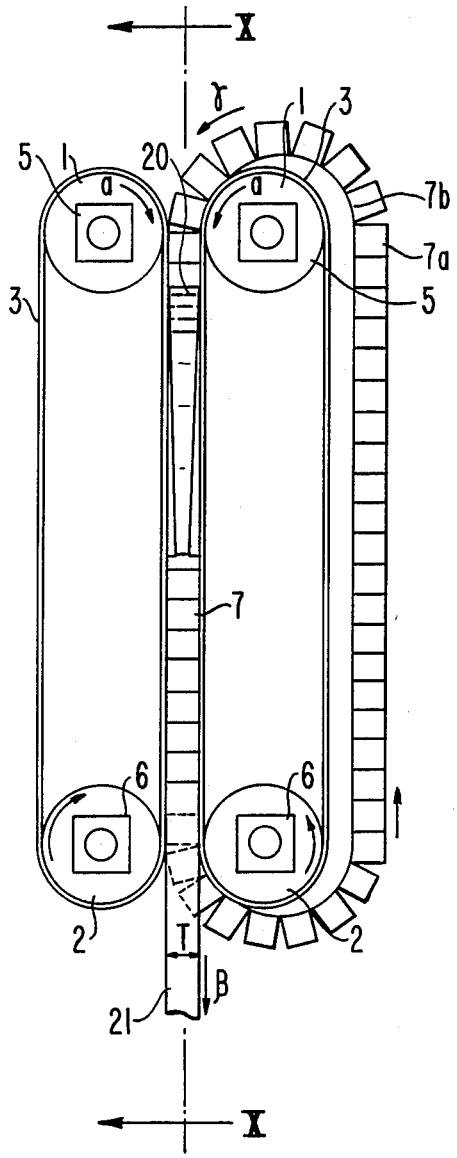
FIG. 9 (PRIOR ART)
FIG. 9 is a side view showing another example of a belt type continuous casting machine in the prior art.
Figure 10:
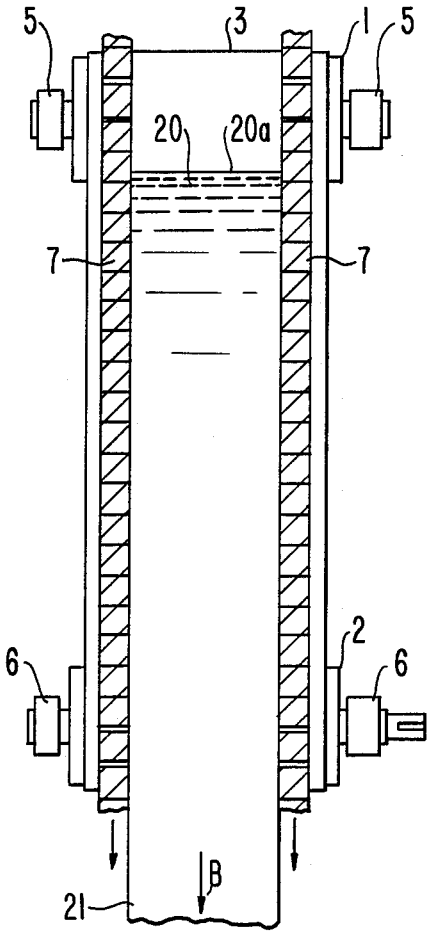
FIG. 10 (PRIOR ART)
FIG. 10 is a vertical cross-sectional front view taken along line X—X in FIG. 9 as viewed in the direction of the arrows thereof.

As shown in FIG. 4, each of the side dam blocks 8*a* forming one sub-group is provided with an arm 81 having a guide roller 8*d* provided at its tip end and a protrusion 81*a* provided at its middle portion. On the other hand, each of the side dam blocks 8*a'* forming the other sub-group is provided with an arm 81' having a guide roller 8*d'* provided at its tip end and a protrusion 81*a'* provided at its tip end and a protrusion 81*a'* provided at its middle portion. The arms 81 are connected to each other by the endless flexible metal belt 8*c*, and the arms 81 are connected to each other by the endless flexible metal belt 8*b*. When the side dam blocks 8*a* and 8*a'* have come to the location of the guide beams 10*b*, 10*a*, then guide rollers 8*d* and 8*d'* move along guide grooves formed in guide beams 10*b* and 10*a*, respectively. Thus, the movements of the side dam blocks 8*a* and 8*a'* are guided by the guide beams 10*b* and 10*a*, respectively. On the other hand, when the side dam blocks 8*a* and 8*a'* have come to the location of the fixed guide beams 10*c* and 10*d*, the guide rollers 8*d* of the side dam blocks 8*a* forming one sub-group move along a guide groove formed in fixed guide beam 10*d*, while the guide rollers 8*d'* of the side dam blocks 8*a'* forming the other sub-group move along a guide groove formed in fixed guide beam 10*c*.

On one endless flexible metal belt 8*c* are mounted the protrusions 81*a* of the arms 81 of the side dam blocks 8*a* in the above-mentioned one sub-group. Thereby the side dam blocks 8*a* in the above-mentioned one sub-group are connected with one another by the intermediary of the metal belt 8*c*. Similarly, the protrusions 81*a'* of the arms 81' of the side dam blocks 8*a'* in the other sub-group are mounted on the other endless flexible metal belt b*b* and thereby likewise are connected with one another by the intermediary of the metal belt b*b*. In addition, as shown in FIG. 4, at the location where the side dam blocks 8*a'* forming the other sub-group are present, a plurality of guide blocks 9*a* are mounted on the above-mentioned one endless flexible metal belt 8*c*. Thus, guide rollers 9*b* mounted at the tip ends of the guide blocks 9*a* move along the guide grooves formed in the movable guide beam 10*b* and in the fixed guide beam 10*d* and are guided by such guide grooves. Also, at the location where the side dam blocks 8*a* forming the above-mentioned one sub-group are present, a plurality of guide blocks 9*a'* are mounted on the other endless flexible metal belt b*b*. Thus, guide rollers 9*b* ' mounted at the tip ends of the guide blocks 9*a'* move along the guide grooves formed in the movable guide beam 10*a* and in the fixed guide beam 10*c* and are guided by such guide grooves.

Figure 3:
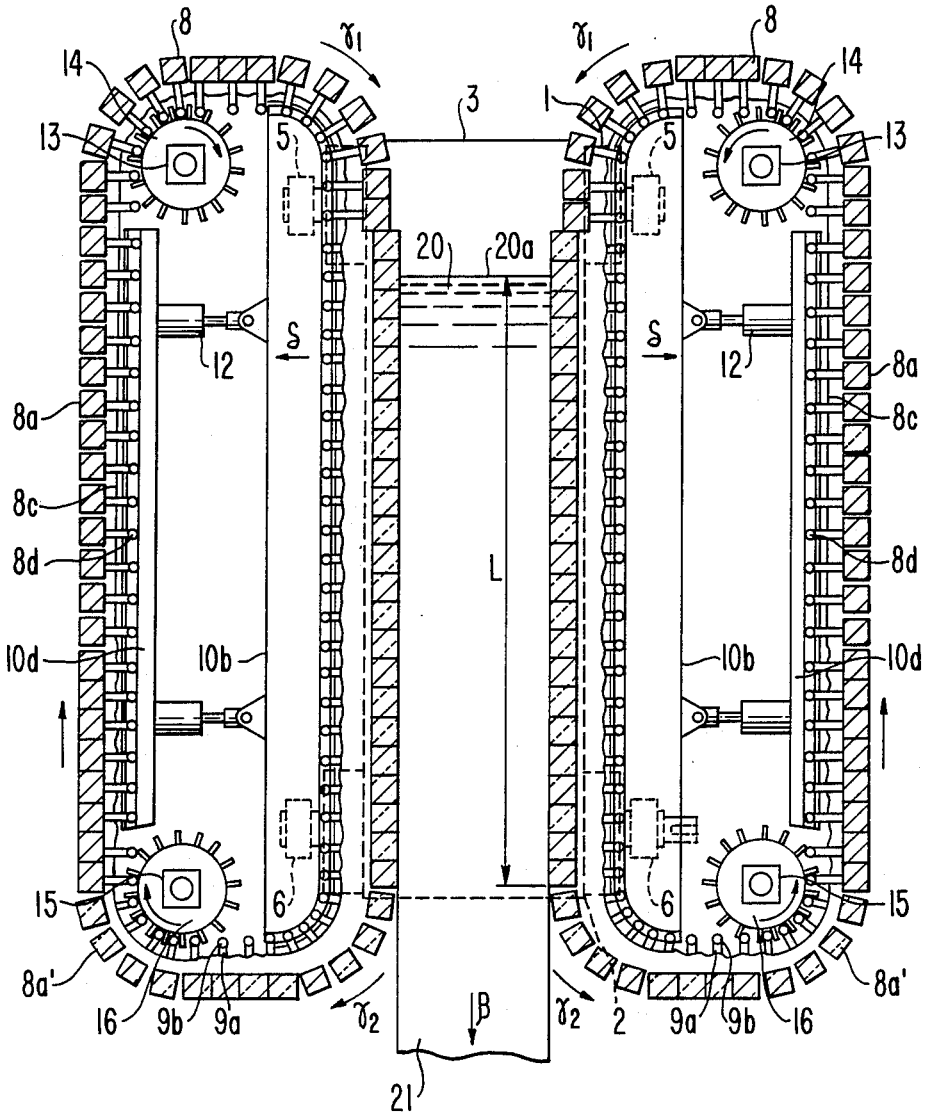
FIG. 3 is a vertical cross-sectional rear view taken along line III—III in FIG. 1 as viewed in the direction of the arrows thereof.

As described above, the plurality of side dam blocks 8*a* and 8*a'* are connected with one another by the intermediary of the respective endless metal belts 8*c* and b*b* to form respective endless loops. As shown in FIGS. 2 and 3, such endless loops are transferred to between the water-cooled belts 3 in the directions indicated by arrows $\gamma_1$ by means of sprockets 14 supported by fixed bearings 13 and driven by a driving device, not shown, and then they are transferred from between the water-cooled belts 3 in the directions indicated by arrows $\gamma_2$ by means of sprockets 16 supported by fixed bearings 15 and driven by a driving device, not shown. The side dam blocks 8*a* and 8*a'* thus are moved in endless recirculating paths.

During the above-mentioned movement, as described above, the guide rollers 8*d* of the arms 81 of the side dam blocks 8*a* forming the above-mentioned one sub-group and the guide rollers 9*b* of the guide blocks 9*a* mounted on the flexible metal belt 8*c* connecting side dam blocks 8*a* move together along the guide grooves formed in the movable guide beam 10*b* and the fixed guide beam 10*d* and are guided by such guide grooves, whereas the guide rollers 8*d'* of the arms 8*a'* of the side dam blocks 8*a'* forming the other sub-group and the guide rollers 9*b'* of the guide blocks 9*a'* mounted on the flexible metal belt b*b* connecting side dam blocks 8*a'* move together along the guide grooves formed in the movable guide beam 10*a* and the fixed guide beam 10*c* and are guided by such guide grooves.

Molten metal 20 is continuously fed from the side of the tension pulleys 1 (that is, from above in FIGS. 1 to 3) and is cooled and solidified in the mold section formed of the two water-cooled belts 3 and the two side dams 8 which move downwards as viewed in FIGS. 2 and 3 as shown by arrows $\gamma_1$ at the same speed as the water-cooled belts 3 due to a pinching force of the two water-cooled belts 3. The thus formed cast piece 2 is ejected downwardly as viewed in FIGS. 1 to 3 as indicated by arrow $\gamma$ at a speed substantially equal to a linear speed of the water-cooled belts 3, and then is sent to the next step of the process.

In the following, description will be made of the operation when it is contemplated to change the width of the cast piece 21 while the cast piece 21 is being cast.

Now it is assumed that the sub-groups of side dam blocks 8*a'* are held in contact with the molten metal 20 as shown in FIGS. 2 to 4. At this moment, the other sub-groups of side dam blocks 8*a* are located at a position where they are not held in contact with the molten metal 20 as shown in these figures. Then, one movable guide beam 10*b* corresponding to the sub-group of side dam blocks 8*a* is moved in the widthwise direction of the cast piece 21 (in the direction indicated by an arrow $\delta$) as shown in FIG. 3 by actuating respective of the air cylinders 12. The sub-group of side dam blocks 8*a'* held in contact with the molten metal 20 are not influenced at all by this movement of the guide beam 10*b*, and casting is further continued with the cast piece width before that time kept intact. However, when the foremost end of the sub-group of side dam blocks 8*a* has come to the position of the movable guide beam 10*b*, due to the fact that the rollers 8*d* of the side dam blocks 8*a* enter the guide groove formed in the same guide beam 10*b*, the side dam blocks 8*a* occupy the positions displaced in the direction indicated by an arrow $\delta$ as shown in FIG. 3, and when these side dam blocks 8*a* have moved to the position where the side dam block 8*a* is held in contact with the molten metal 20, the width of the cast piece 21 will be enlarged in a single, immediate step-wise manner. In this way, the casting is continued subsequently with the width of the cast piece 21 enlarged.

In the case of reducing the width of the cast piece 21, by moving either one of the movable guide beams 10*a* and 10*b* in the direction opposite to the direction $\delta$, the width of the cast piece 21 likewise can be narrowed.

According to the present invention, during a casting operation the width of a cast piece 21 can be arbitrarily changed in the above-described manner.

In addition, upon change of the width of the cast piece 21, since either the side dam blocks 8*a* or the side dam blocks 8*a'* are preliminarily moved in the widthwise direction of the cast piece 21 at a location where they are not held in contact with molten metal 20, the change of the width of the cast piece can be achieved without the movement of the side dam blocks having any influence upon the cast piece 21. Thus, the width of the cast piece is changed immediately in a single step-wise manner, as shown schematically in FIG. 6. Hence, the manufactured cast piece does not contain a portion having a gradually changing width, and thereby the product yield can be improved.

Furthermore, in the illustrated embodiment, since the movement of the side dam blocks 8*a* or 8*a'* is carried out before they come into contact with the water-cooled belts 3 as shown in FIGS. 2 and 3, during such movement the side dam blocks 8*a* or 8*a'* will not be subjected to frictional resistance due to contact with the water-cooled belts 3, and thereby such movement can be carried out smoothly. In addition, since the side dam blocks 8*a* or 8*a'* are preliminarily moved in the widthwise direction of the cast piece before they come into contact with the water-cooled belts 3 and never are moved in the widthwise direction after they have come into contact with the water-cooled belts 3, the necessary good seal between the water-cooled belts 3 and the side dams 8 is well preserved.

According to the present invention, in addition to the advantage that a cast piece of high quality that is free from defects such as caused by seizure can be obtained because side dams are moved in synchronism with the cast piece, a further advantagc can be obtained in that by moving a guide beam corresponding to a side dam block sub-group not held in contact with a cast piece in the widthwise direction of the cast piece during a continuous casting operation, the width of a cast piece can be changed while continuously carrying out casting without interruption.

In addition, since the movement of the side dam blocks in the widthwise direction of the cast piece is carried out before the side dam blocks come into contact with molten metal, a change of the width of the cast piece can be achieved without the movement of the side dam blocks having an influence on the molten metal and without deteriorating the quality of the manufactured cast piece.

Still further, as the width of the cast piece is changed discontinuously in a step-wise manner, the manufactured cast piece does not contain a portion having a gradually changing width, and hence product yield can be improved.

It is noted that if the above-described movement of the side dam blocks in the widthwise direction of the cast piece is carried out before the side dam blocks come into contact with the water-cooled belts, then the movement of the side dam blocks can be performed smoothly.

As described in detail above, according to the present invention, restrictions imposed upon changing the width of a cast piece largely can be mitigated, and hence production of a cast piece having a width that is freely variable over a broad range becomes possible, the availability factor of a manufacturing installation is also largely improved, and the yield of cast pieces can be enhanced.

While the principle of the present invention has been described above with relation to one preferred embodiment of the invention, it is a matter of course that many apparently widely different embodiments of the present invention could be made without departing from the spirit of the present invention.

What is claimed is:

1. A belt type continuous casting machine for continously casting molten metal into a continuously discharged cast piece, said machine comprising:

a pair of cooled endless belts extending parallel to each other to define first opposite spaced sides of a mold space for receiving moltent metal, said belts being movable in synchronism in respective endless paths;

a pair of endless side dams extending parallel to each other to define second opposite spaced sides of said mold space, each said side dam being pinched on opposite sides thereof between said pair of endless belts, said pair of side dams being movable in respective endless paths in synchronism with said pair of endless belts;

whereby molten metal continuously introduced into said mold space is continuously moved in a casting direction while being solidified, and a resultant cast piece is continously discharged from said mold spaced;

each said side dam comprising a group of a plurality of side dam blocks arranged sequentially in contact in a single row in the respective said endless path, said group of blocks being arranged in first and second successive sub-groups, each said sub-group having a length along said respective endless path at least longer than the length of said side dam in contact with the molten metal and cast piece;

each said side dam having associated therewith a respective guide, each said guide comprising first and second movable guide beams extending parallel to each other at a position adjacent said mold space and extending along the entire length thereof in said casting direction, first and second fixed guide beams extending parallel to each other at a position spaced from said mold space, and means mounting said first and second movable guide beams on said first and second fixed guide beams, respectively, for selected independent movement toward and away from said mold space; and said blocks of said first sub-group being guided during movement along said respective endless path by said first movable guide beam and said first fixed guide beam, and said blocks of said second sub-group being guided during movement along said respective endless path by said second movable guide beam and said second fixed guide beam.

2. A machine as claimed in claim 1, wherein, for each said side dam, said blocks of said first sub-group are connected to each other by a first loop-shaped flexible belt, and said blocks of said second sub-group are connected to each other by a second loop-shaped belt.

3. A machine as claimed in claim 2, wherein said blocks of said first sub-group have respective rollers guided by said first fixed guide beam and said first movable guide beam, and said blocks of said second sub-group have respective rollers guided by said second fixed guide beam and said second movable guide beam.

4. A machine as claimed in claim 2, further comprising, along the portion of the length of said endless side dam including said blocks of said first sub-group, a first plurality of guide blocks connected to said second loop-shaped belt and guided during movement by said second fixed guide beam and said second movable guide beam, and, along the portion of said length of said endless side dam including said blocks of said second subgroup, a second plurality of guide blocks connected to said first loop-shaped belt and guided during movement by said first fixed guide beam and said first movable guide beam.

5. A machine as claimed in claim 4, wherein said first plurality of guide blocks have respective rollers guided by said second fixed guide beam and said second movable guide beam, and said second plurality of guide blocks have respective rollers guided by said first fixed guide beam and said first movable guide beam.

6. A machine as claimed in claim 1, wherein said fixed guide beams extend parallel to said movable guide beams.

7. A machine as claimed in claim 1, wherein said mounting means comprise respective independently operable driving devices connecting each said movable guide beam to the respective said fixed guide beam.

8. A machine as claimed in claim 1, wherein said endless poath of movement of each said side dam includes an upper portion moving toward said mold space, a vertical portion moving downwardly along said mold space, a nearly horizontal lower portion moving away from said mold space, and a vertical return portion moving upwardly from said lower portion to said upper portion and at least said movable guide beams extend vertically between said upper and lower portions

9. A machine as claimed in claim 1, wherein said pair of cooled endless belts are water cooled.

* * * * *